US005924390A

United States Patent [19]

Bock

[11] Patent Number: 5,924,390

[45] Date of Patent: Jul. 20, 1999

[54] WATER HEATER WITH CO-LOCATED FLUE INLET AND OUTLET

[76] Inventor: John C. Bock, 9 Cambridge Rd., Madison, Wis. 53704

[21] Appl. No.: 08/808,137

[22] Filed: Feb. 28, 1997

[51] Int. Cl.[6] ..... F22B 5/04

[52] U.S. Cl. ..... 122/14; 122/17; 110/162; 126/350 R

[58] Field of Search ..... 122/14, 17, 19; 110/162, 163; 126/350 R

[56] References Cited

U.S. PATENT DOCUMENTS

| | | | |
|---|---|---|---|
| 2,764,972 | 10/1956 | Ryder | 126/307 |
| 3,091,223 | 5/1963 | Vitale | 122/17 |
| 3,659,560 | 5/1972 | Carter | 122/494 |
| 3,707,142 | 12/1972 | Kobayashi | 122/17 |
| 4,111,004 | 9/1978 | Blomberg | 62/476 |
| 4,239,953 | 12/1980 | Bock | 219/79 |
| 4,641,631 | 2/1987 | Jatana | 122/14 |
| 4,761,532 | 8/1988 | Bock | 219/79 |
| 4,940,042 | 7/1990 | Moore, Jr. et al. | 126/344 |
| 4,995,375 | 2/1991 | Jackson | 126/85 B |
| 5,020,512 | 6/1991 | Vago et al. | 126/350 R |
| 5,174,743 | 12/1992 | Wellman et al. | 431/187 |
| 5,375,651 | 12/1994 | Colwell | 110/162 |
| 5,524,556 | 6/1996 | Rowlette et al. | 110/162 |
| 5,575,273 | 11/1996 | Moore, Jr. | 126/350 R |
| 5,697,330 | 12/1997 | Yetman et al. | 122/14 |

FOREIGN PATENT DOCUMENTS 55-30306 2/1980 Japan .

OTHER PUBLICATIONS

"Bock Cglass® Lined Oil Water Heaters" flyer, Form No. 1008, Rev. 3–96, Bock Water Heaters, Madison, Wisconsin.

*Primary Examiner*—Teresa Walberg
*Assistant Examiner*—Gregory A. Wilson
*Attorney, Agent, or Firm*—Lathrop & Clark LLP

[57] ABSTRACT

A blower draws air through an inlet duct from outside a building or dwelling and injects air and fuel into a sealed combustion chamber where they are ignited and burned within a ceramic crucible within combustion chamber. The pressurized combustion gases flow up an exhaust stack in the water tank of the water heater. The exhaust stack is connected to a vent that extends through a building outside wall. The vent is surrounded by the inlet duct which has an opening spaced from the outlet vent so that air from the vent is not captured by the inlet. The combustion chamber and the heat exchanger are sealed from the interior of the building and both the air inlet to the blower and the air outlet from the heat exchanger freely communicate to the outside of the building. A timer within the controller operates the blower for a period of time after the fuel supply to the burner has been shut off. This operation of the blower assures that residual heat within the combustion chamber is transferred to the water in the tank.

15 Claims, 3 Drawing Sheets

WATER HEATER WITH CO-LOCATED FLUE INLET AND OUTLET

FIELD OF THE INVENTION

The present invention relates to water heaters in general and to potable water heaters and/or combination water-heaters/space-heaters, employing co-located flue inlets and outlets in particular.

BACKGROUND OF THE INVENTION

As a result of the energy crisis the trend toward the development of higher efficiency heating appliances has accelerated. This trend was further facilitated by a growing concern with the environment with its emphasis on reducing the use of natural resources. The resulting greater concern for energy efficiency both in furnaces, water heaters and home insulation resulted in major improvements in home energy efficiency. The push toward greater efficiency also had effects on construction techniques and design choices.

One important energy saving construction technique was reducing air infiltration into and out of a building. So-called tight construction requires appliances that require no aspiration or which ventilate directly to the outside. This led to the installation of many electric water heaters and electric heat-pumps.

Builders immediately took advantage of the appliances and construction techniques to reduce construction costs by eliminating chimneys in new construction. Although electric water heaters and heat-pumps do not require a chimney because they do not produce exhaust gases, they are typically more costly to operate than a gas or oil fired water heater.

So called "direct vent" gas fired water heaters were developed and used to replace the electric water heaters in homes built without chimneys. However the typical direct vent water heater uses a fan that draws air from the home to dilute the exhaust gases so they are sufficiently low in temperature to be exhausted without a chimney. In a modern tightly constructed home drawing air from the home both for combustion and for dilution presents a supply problem in obtaining sufficient makeup air.

Another type of water heater, exemplified in U.S. Pat. Nos. 5,020,512 and 3,707,142, brings makeup air to the water heater from outside, through an annulus around the exhaust pipe. This coaxial duct arrangement has two benefits. First, the inner exhaust pipe is cooled and insulated allowing it to penetrate the wall of a house without necessitating a chimney. Secondly the makeup air for combustion is supplied from the building exterior at the same pressure at which the exhaust pipe discharges. This type of water heater relies on natural draft to control the circulation of air. Use of natural draft limits the placement of the unit within a building and requires standard exhaust components to assure functioning of the natural draft.

In many parts of this country and other countries natural gas is not available and heating oil is the preferred fuel for home and water heating. High quality oil fired water heaters have realized extended installed lives with only routine maintenance. This type of water heater has, particularly in the market for oil fired water heaters, established a market requirement for extreme durability.

What is needed is an oil fired water heater which can be installed in a home without a chimney.

SUMMARY OF THE INVENTION

The water heater of this invention employs a burner which incorporates a blower and a controller. The blower draws air from outside the building or dwelling through an inlet duct. The blower injects air and fuel into a relatively air tight combustion chamber where the combination is ignited and burned within a ceramic crucible within the relatively air tight combustion chamber. The pressurized combustion gases flow up through a heat exchanger in the water tank of the water heater to a connected exhaust stack. The exhaust stack is connected by a flexible metal conduit to a vent that extends horizontally through the outside wall of the dwelling. The vent is surrounded by an inlet duct that defines an air inlet annulus around the vent. The inlet duct is spaced from the outlet vent so that air from the vent is not captured by the inlet. At the same time the spacing between the inlet and the outlet are such that they see nearly the same atmospheric pressure despite the direction and intensity of outside atmospheric phenomenon. Thus the combustion chamber and the heat exchanger are sealed from the interior of the building and both the air inlet to the blower and the air outlet from the heat exchanger freely communicate with the outside of the building. A timer within the controller operates the blower for a period of time after the fuel supply to the burner has been shut off. This operation of the blower assures that residual heat in the combustion chamber is transferred to the water in the tank.

The benefits of using a water heater thus described is that no air is drawn from the house. The water heater operates with a co-located flue inlet and outlet so that backdraft through the burner and the burner blower is prevented with today's tight house. Because both the inlet and outlet are similarly located there is little or no pressure differential between the outlet and the inlet and thus flow of air is governed by the operation of a blower which supplies air to the burner. The use of a burner with a blower allows a greater heating capability in a water heater so that a relatively small water heater can supply heat of 100,000 to 150,000 BTU which is sufficient supply of heat to heat an average to large home.

It is an object of the present invention to provide a water heater that burns oil or gas with a powered blower, and can be installed without a chimney.

It is another object of the present invention to provide a direct vent water heater which does not draw air from the building in which it is installed.

It is a further object of the present invention to provide a water heater that has a relatively air tight combustion chamber.

It is a yet further object of the present invention to provide a water heater where the air supplied to the blower fan and the exhaust outlet are co-located so that retained heat in the combustion chamber continues to flow up through the stack when the blower is turned off.

It is a still further object of the present invention to provide a water heater with sufficient heating capability to heat a home.

Further objects, features and advantages of the invention will be apparent from the following detailed description when taken in conjunction with the accompanying drawings.

DESCRIPTION OF THE PREFERRED EMBODIMENT

Figure 1:
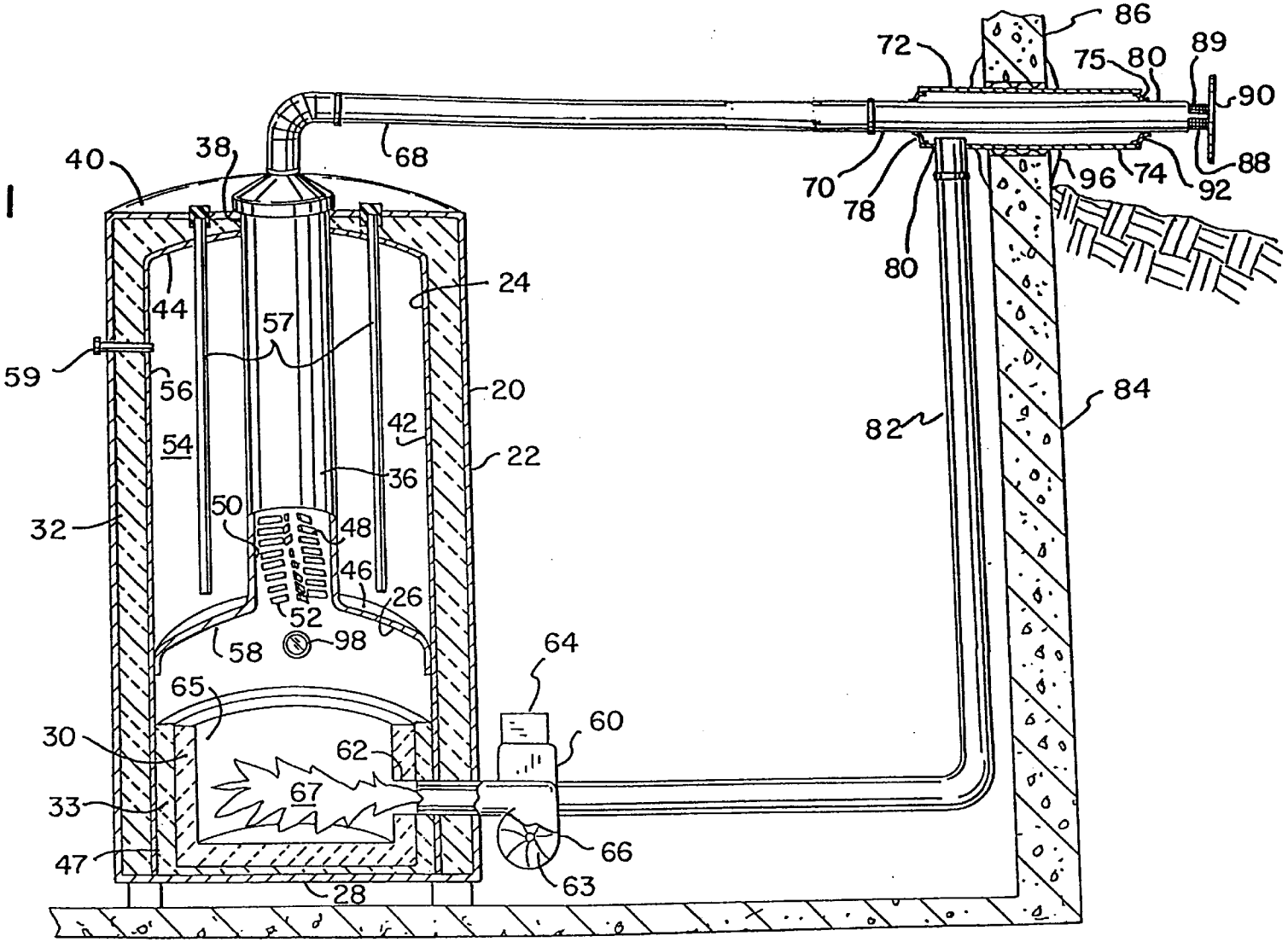
FIG. 1 is an cutaway cross-sectional view of a water heater and coaxial exhaust and air inlet of this invention.
Figure 2:
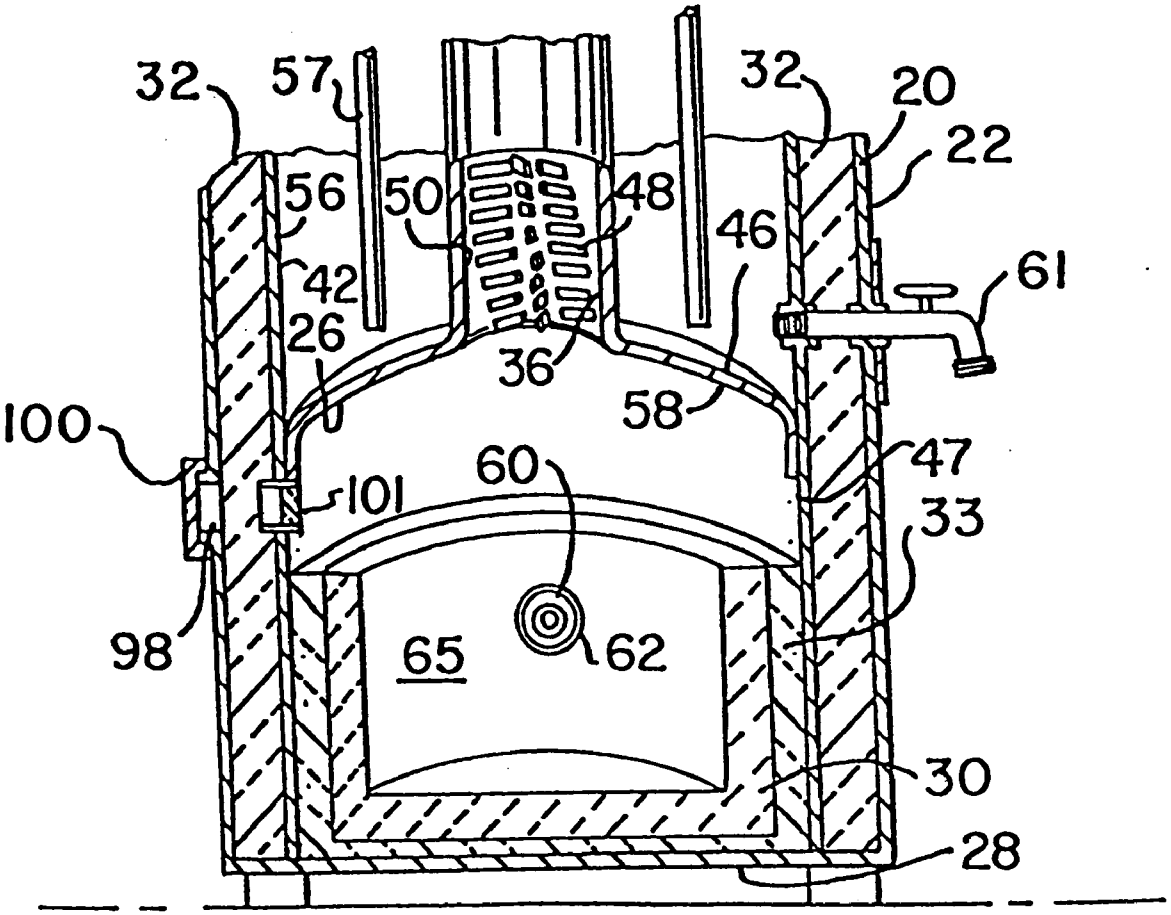
FIG. 2 is a cross-sectional view of the combustion chamber of the water heater of FIG. 1.
Figure 3:
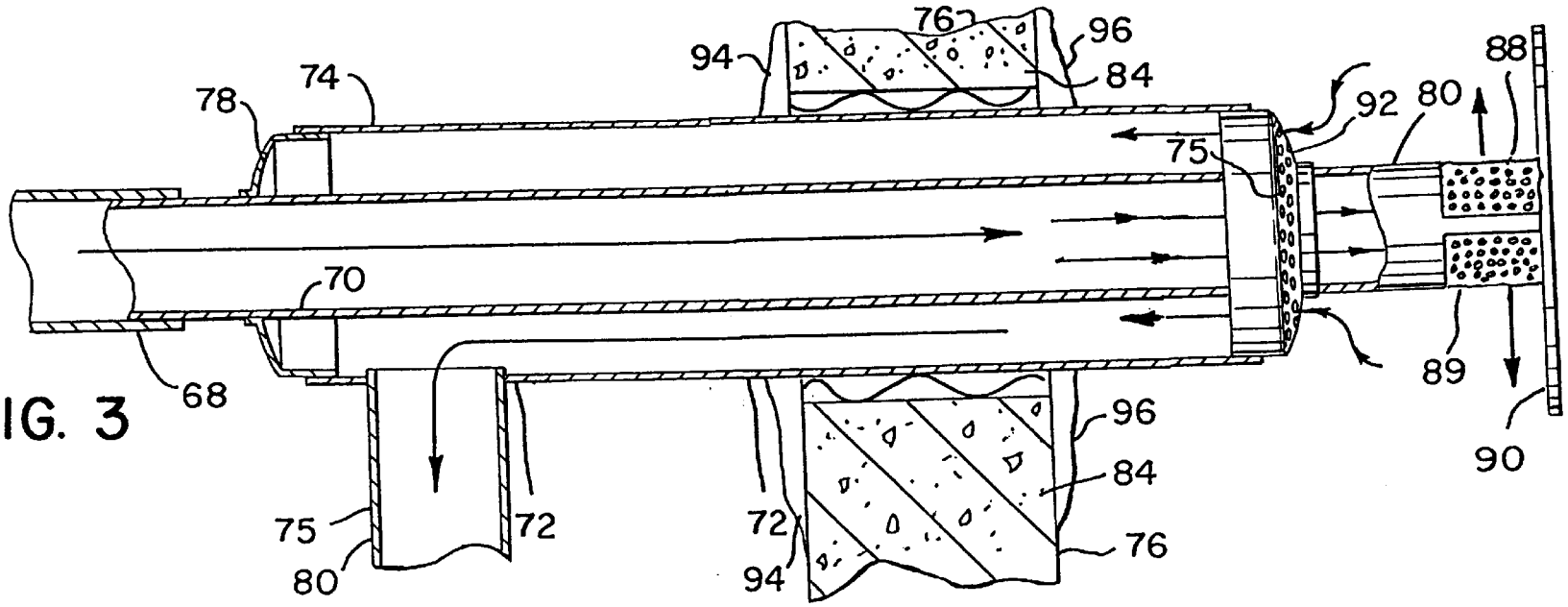
FIG. 3 is a cross-sectional view of the coaxial exhaust and air inlet of this invention.

Referring more particularly to FIGS. 1–3 wherein like numbers refer to similar parts, a water heater 20 is shown in FIG. 1. The water heater 20 is designed to utilize a blower and incorporates a flame holding crucible in the combustion chamber. The crucible is necessary for an oil-fired burner. Further, to accommodate modern tight construction, the water heater is installed so that no air is drawn from inside the dwelling in which the water heater is placed.

The water heater 20 has an outer jacket 22 which encloses a water tank 24 which is welded to form a combustion chamber 26. The combustion chamber 26 is closed by a bottom pan 28. A ceramic crucible 30 is positioned within the combustion chamber 26 as shown in FIG. 2. The combustion chamber 26 and water tank 24 are insulated from the outer jacket 22 by insulation 32. The crucible 30 is further insulated by insulation 33 from the skirt or wall 47 of the combustion chamber and from the bottom pan 28.

A stack 36 extends from the combustion chamber 26 through the water tank 24 tube to an exhaust port 38 which passes through the top pan 40 of the outer jacket 22. The water tank 24 and the combustion chamber together with the stack 36 are formed as a weldment consisting of an outer cylindrical shell 42, a top dome 44, a bottom dome 46, and a skirt 47. The skirt 47 is joined to the outer cylindrical shell 42 and defines the combustion chamber 26. The stack 36 is welded between the bottom dome 46 and the top dome 44.

A multiplicity of steel tabs 48 are welded to the interior surface 50 of the stack 36. The steel tabs 48 are welded to form overlapping spirals 52. The steel tabs may be welded by one of the processes disclosed in U.S. Pat. Nos. 4,239,953 or 4,761,532. The steel tabs 48 increase the transfer of heat from the exhaust gases which pass through the stack to the water 54 in the tank 24.

The interior surfaces 56 of the water tank 24 are coated with a baked-on glass finish to increase the corrosion resistance of the water tank 24. The underside 58 of the bottom dome 46 and a portion of the steel tabs 48 adjacent to the dome underside 58 are also coated with a glass finish. The water tank 24 has replaceable anode rods 57, a pressure relief valve 59, and a drain valve 61. The relief valve 59 and drain valve 61 can be removed to inspect and gain access to the interior of the water tank 24.

A fuel oil burner 60 is mounted to the outer jacket 22 and directs a stream of air and fuel oil into the crucible 30 through a hole 62 formed in the side 65 of the crucible 30. An ignitor (not shown) ignites the air and fuel oil mixture, the combustion of which heats the crucible 30 and the water tank 24 positioned above the combustion chamber 26. The burner 60 is a Wayne Blue Angel burner supplied by the Wayne/Scott Fetzer Company of Fort Wayne Ind. This type of burner incorporates a blower 63 and is similar to the burner disclosed in U.S. Pat. No. 5,174,743 which is incorporated herein by reference. Burners similar to burner 60 burning either oil, gas, or propane are easily sized to supply 100,000 BTU. This allows the possibility of using a single water heater to supply all the heating needs of a home: both potable water heating and space heating.

The crucible 30 serves to contain the flame 67. During the firing cycle inner portions of the crucible become incandescent. Operating the blower 63 for a period of time after the burner 60 has been shut off serves to cool the crucible 30 and to transfer the heat from the crucible to the water by heat exchange with the water by means of the stack 36.

The burner 60 is controlled by a controller 64 which receives inputs from a water temperature sensor and limit device (not shown), a cadmium sulfide flame detector, and a burner-mounted relay which operates the fuel supply valve (not shown). The controller includes a timer that operates the blower for a period of time after the burner has shut down. After burner shut-down, the blower 63 should be operated for at least twenty minutes and preferably for twenty to forty-five minutes depending on the size of the blower and the thermal mass of the crucible.

The blower 63 develops a pressure of about one inch of water column. The pressure in the blower is converted to air velocity by the blower housing 66 and considerable pressure is lost due to the design of the burner which incorporates a frustoconical flow restrictor. The pressure drop in the burner and the blower acts as a fluidic valve preventing combustion gases from entering the burner 60.

Exhaust gases leave the stack 36 at the exhaust port 38 and enter an exhaust duct 68 that can be constructed of flexible stainless steel duct suitable for 500 degree Fahrenheit temperatures or standard galvanized steel duct work. As shown in FIG. 3, the exhaust duct 68 connects to an axial exhaust pipe 70 forming part of a flue 72. The flue 72 has a coaxial outer inlet pipe 74. The outer inlet pipe 74 thermally isolates the exhaust pipe allowing the flue to pass through combustible materials. The outer inlet pipe 74 is sealed to the axial exhaust pipe 70 by a closure 78. A radially extending pipe 80 joins and communicates with the annulus formed between the axial exhaust pipe 70 and the coaxial outer pipe 74. The pipe 80 joints an inlet duct 82 that brings outside air to the blower inlet. The inlet duct 82 can be constructed of aluminum or plastic dryer vent pipe or standard galvanized duct work.

As shown in FIG. 1, the coaxial inlet pipe 74 extends for about three inches to about one foot beyond the exterior wall 84 of the building 86. The axial exhaust pipe 70 extends about one foot to eighteen inches beyond the inlet pipe 74. The exhaust pipe 70 terminates with a two inch cylindrical section 88 having small holes forming an exhaust outlet 89 which is capped by a radially extending cap plate 90. The cap plate 90 prevents wind from blowing down the exhaust pipe.

The air inlet opening 75, which lets air into the inlet pipe 74, also has a conical or circumferential inlet screen 92. The cylindrical portion 88 having small holes and the conical inlet 92 are always shaded from the direct action of the wind along part of the air openings. The portion having small holes 88 and conical inlet 92 are sufficiently close to the wall 84 of the building 86 that the wall 84 provides some buffering from wind effects. The exhaust outlet 89 and air inlet 75 are positioned sufficiently close to each other that the exterior pressure environment is essentially identical.

The flue 72 will ideally be placed on a wall that does not face prevailing winter wind. The flue 72 should be placed at least one foot above the maximum expected snow load so as not to block the flue. The flue will preferably be placed at least four feet away from the corners of the building to reduce eddy currents. The flue 72 is about six inches in diameter and the hole through the house wall 84 should be seven inches in diameter with ½ inch non-combustible spacers holding the flue 72 within the hole if the wall is constructed of combustible materials. Flashing rings 94, 96 surround the flue on the inside and on the outside of the building. Caulking around the flashing rings 94, 96 will prevent moisture from the exhaust gases from entering the building 86. The flue 72 should slope downwardly towards the outside of the building 86 so water condensate in the exhaust pipe 70 will drain to the outside.

The inlet duct 82 should be tightly sealed with duct tape or the like. Similarly the exhaust duct 68 should be tight and any joints sealed with high temperature aluminum or stainless steel tape.

In a typical water heater installation the draft in the combustion chamber is about 0.02 inches of water vacuum produced by the draft in the stack as the result of hot gases rising through the stack. The water heater 20 can have a slight positive pressure of about 0.02 inches of water as a result of the sealed design. This slight pressure in the combustion chamber 26 means that the combustion chamber 26 must be sealed to prevent hot gases from escaping from the combustion chamber 26. A sight hole 98, shown in FIG. 2, is accessible through a door 100, and incorporates a high temperature glass window 101 which allows viewing of the combustion chamber without allowing gas to escape from the sealed combustion chamber 26. Viewing the combustion chamber is important to check adjustment of the burner flame.

It should be understood that the flue 72 will typically be constructed of stainless steel for durability. The exhaust port 38 at the top of the stack 36 is typically six inches in diameter and may be connected to a six inch by four inch reducer. The exhaust duct and inlet duct may be four inches in diameter because natural draft is not being relied on.

When the water heater 20 is not being fired and the blower 63 is turned off little or no air will circulate through the combustion chamber 26 and stack 36 thus reducing heat loss.

The blower 63 and the flow restrictions in the burner 60 act as a check valve or fluidic diode that prevents back drafts from pushing exhaust air back into the burner. The blower 63 with the flow restrictor acts as an air supply valve in which the operable part is the blower.

It should be understood that the exhaust outlet 89 should be positioned at least six feet from windows and doors because of the large amount of moisture given off by the flue. The exhaust duct 68 should be of an insulated type where clearances from combustibles require. The attachment of the exhaust duct 68 to the exhaust port 38 should be removable for periodic inspection and cleaning.

It should be understood that the water heater of this invention may also be employed with a natural gas or propane fired burner, so long as a blower is utilized.

It should be understood that the air inlet 75 is closely spaced from the exhaust outlet 89, typically about six inches to about eighteen inches.

It is understood that the invention is not limited to the particular construction and arrangement of parts herein illustrated and described, but embraces such modified forms thereof as come within the scope of the following claims.

I claim:

1. A water heater mounted interiorly to a dwelling and having a flue that extends through an exterior wall of the dwelling comprising:

a water tank;

a combustion chamber mounted beneath the water tank and sealed to the tank;

a stack extending upwardly from the combustion chamber and through the water tank in heat exchanging relation to the tank;

a burner equipped with a fan, a fuel supply valve, and a controller, the fan and fuel supply valve providing a combustible mixture to the combustion chamber;

a flue extending through an exterior wall, the flue having an axial exhaust pipe and an outer coaxial air inlet pipe, the exhaust pipe extending to an exhaust outlet exterior to the dwelling, the exhaust outlet being surrounded by the coaxial air inlet pipe which extends to an air inlet that is exterior to the dwelling and which is closely spaced from the exhaust outlet;

a temperature resistant duct between the stack and the exhaust pipe;

a duct communicating between the burner fan and the air inlet pipe to supply air to the burner and the combustion chamber, wherein the controller includes a timer having a timing capability of at least twenty minutes and wherein the controller is connected to the fan so that the timer activates the fan for at least twenty minutes after the fuel supply valve is turned off; and a sight tube penetrating the combustion chamber to give visual access to the combustion chamber, the sight tube being sealed by a high temperature window to prevent air from escaping the combustion chamber through the sight tube.

2. The water heater of claim 1 wherein the stack has a circular interior wall and multiple metal tabs extending from the wall to improve heat exchange between gases moving up through the stack and the water tank.

3. The water heater of claim 1 wherein the burner is of the type which utilizes heating oil as the combustion fuel.

4. A water heater mounted interiorly to a dwelling and having a flue that extends through an exterior wall of the dwelling comprising:

a water tank;

a combustion chamber mounted beneath the water tank and sealed to the tank;

a stack extending upwardly from the combustion chamber and through the water tank in heat exchanging relation to the tank;

a burner equipped with a fan, a fuel supply valve, and a controller, the fan and fuel supply valve providing a combustible mixture to the combustion chamber;

a flue extending through an exterior wall, the flue having an axial exhaust pipe and an outer coaxial air inlet pipe, the exhaust pipe extending to an exhaust outlet exterior to the dwelling, the exhaust outlet being surrounded by the coaxial air inlet pipe which extends to an air inlet that is exterior to the dwelling and which is closely spaced from the exhaust outlet;

a temperature resistant duct between the stack and the exhaust pipe;

a duct communicating between the burner fan and the air inlet pipe to supply air to the burner and the combustion chamber, wherein the controller includes a timer having a timing capability of at least twenty minutes and wherein the controller is connected to the fan so that the timer activates the fan for at least twenty minutes after the fuel supply valve is turned off, and a ceramic crucible mounted within the combustion chamber, the crucible having a bottom surrounded by an upwardly extending side wall.

5. The water heater of claim 4 wherein the crucible has an opening defined in the upwardly extending side wall through which the combustible mixture is supplied to the combustion chamber.

6. A water heater mounted interiorly to a building and having a flue that extends through an exterior wall of the building comprising:

a water tank;

a combustion chamber mounted beneath the water tank and sealed to the tank;

a ceramic crucible mounted within the combustion chamber, the crucible having a bottom surrounded by an upwardly extending side wall;

a stack extending upwardly from the combustion chamber and through the water tank in heat exchanging relation to the water tank;

a burner equipped with a fan and a fuel supply valve, the fan and fuel supply valve providing a combustible mixture to the crucible through an opening in the wall of the crucible within the combustion chamber;

a flue extending through an exterior wall, the flue having an inner exhaust pipe and an outer coaxial air inlet pipe, the exhaust pipe extending to an exhaust outlet exterior to the dwelling, the outlet being surrounded by a coaxial air inlet pipe extending to an air inlet exterior to the dwelling and closely spaced from the exhaust outlet;

a temperature resistant duct communicating in sealed relation between the stack and the exhaust pipe;

a duct communicating between the burner fan and the air inlet pipe to supply air to the burner and the combustion chamber.

7. The water heater of claim 6 further comprising a controller including a timer having a timing capability of at least twenty minutes, wherein the controller is connected to the fan so that the timer activates the fan for at least twenty minutes after the fuel supply valve is turned off.

8. The water heater of claim 6 wherein the stack has a circular interior wall and multiple metal tabs extending from the wall to improve heat exchange between gases moving up through the stack and the water tank.

9. The water heater of claim 6 wherein the burner is of the type utilizing heating oil as the combustion fuel.

10. The water heater of claim 6 further comprising a sight tube penetrating the combustion chamber to give visual access to the combustion chamber, the sight tube being sealed by a glass window to prevent air from entering the combustion chamber through the sight tube.

11. A method of heating water in a water heater comprising the steps of:

introducing cold water to be heated to a water tank mounted above a combustion chamber sealed to the tank, the combustion chamber containing a ceramic crucible mounted within the combustion chamber, the crucible having a bottom surrounded by an upwardly extending side wall;

sensing the introduction of cold water to the water tank and turning on a fan, and a fuel supply valve, forming part of a burner;

providing a combustible mixture of air and fuel to the crucible through an opening in the wall of the crucible within the combustion chamber;

igniting the combustible mixture and heating the ceramic crucible and the water tank;

passing combustion gases through a stack extending upwardly from the combustion chamber;

ducting combustion gasses to a flue extending through an exterior wall, the flue having an inner exhaust pipe and an outer coaxial air inlet pipe, the exhaust pipe extending to an exhaust outlet exterior to the dwelling, the outlet being surrounded by a coaxial air inlet pipe which extends to an air inlet exterior to the dwelling, the air inlet being closely spaced from the exhaust outlet;

ducting air from the exterior of the building to burner fan and the air inlet pipe to supply air to the burner and the combustion chamber;

monitoring the temperature of the water in the water tank and turning off the fuel supply valve when the temperature in the tank reaches a selected value; and turning off the fan after a time lapse of between twenty and forty-five minutes after the fuel supply valve is turned off.

12. The method of heating water of claim 11 further comprising the step of exchanging heat with water in the tank by passing the exhaust gases through the stack end around multiple metal tabs extending from an interior wall of the stack to improve heat exchange between gases moving up through the stack and the water tank.

13. The method of heating water of claim 11 wherein the fuel provided to form the combustible mixture of air and fuel is heating oil.

14. The method of heating water of claim 11 further comprising the step of inspecting the combustion chamber while the burner is operating by looking through a sight hole which is sealed from the combustion chamber by a glass window.

15. A water heater mounted interiorly to a building and having a flue that extends through an exterior wall of the building comprising:

a water tank;

a combustion chamber mounted beneath the water tank and sealed to the tank;

a ceramic crucible mounted within the combustion chamber, the crucible having a bottom surrounded by an upwardly extending side wall;

a stack extending upwardly from the combustion chamber and through the water tank in heat exchanging relation to the tank;

a burner equipped with an air supply valve and a fuel supply valve, the air supply valve and fuel supply valve providing a combustible mixture to the crucible through an opening in the wall of the crucible within the combustion chamber;

a flue extending through an exterior wall, the flue having an inner exhaust pipe and an outer coaxial air inlet pipe, the exhaust pipe extending to an exhaust outlet exterior to the dwelling, the outlet being surrounded by a coaxial air inlet pipe extending to an air inlet exterior to the dwelling and closely spaced from the exhaust outlet;

a temperature resistant duct communicating in between the stack and the exhaust pipe;

a duct communicating between the burner and the air inlet pipe to supply air to the burner and the combustion chamber; and a controller including a timer having a timing capability of at least twenty minutes, wherein the controller is connected to the air supply valve so that the timer activates the air supply valve for at least twenty minutes after the fuel supply valve is turned off.

* * * * *